US008820555B2

(12) United States Patent
Tanaka et al.

(10) Patent No.: US 8,820,555 B2
(45) Date of Patent: Sep. 2, 2014

(54) SYNTHETIC RESIN ROUND BOTTLE

(75) Inventors: Toshimasa Tanaka, Koto-ku (JP); Hiroaki Imai, Koto-ku (JP)

(73) Assignee: Yoshino Kogyosho Co., Ltd., Tokyo (JP)

( * ) Notice: Subject to any disclaimer, the term of this patent is extended or adjusted under 35 U.S.C. 154(b) by 151 days.

(21) Appl. No.: 13/394,686

(22) PCT Filed: Oct. 20, 2010

(86) PCT No.: PCT/JP2010/068503

§ 371 (c)(1),
(2), (4) Date: Mar. 7, 2012

(87) PCT Pub. No.: WO2011/052455

PCT Pub. Date: May 5, 2011

(65) Prior Publication Data

US 2012/0175339 A1 Jul. 12, 2012

(30) Foreign Application Priority Data

Oct. 29, 2009 (JP) ..... 2009-248393

(51) Int. Cl.
*B65D 90/02* (2006.01)
*B65D 1/02* (2006.01)

(52) U.S. Cl.
CPC ..... *B65D 1/0276* (2013.01); *B65D 1/0223* (2013.01)
USPC ..... 215/381; 215/382; 220/669; 220/675

(58) Field of Classification Search
USPC ..... 220/675, 669, 670, 672, 674, 666, 721; 215/381, 382, 384, 383, 900
See application file for complete search history.

(56) References Cited

U.S. PATENT DOCUMENTS 5,303,833 A * 4/1994 Hayashi et al. ..... 215/381
6,585,125 B1 7/2003 Peek (Continued)

FOREIGN PATENT DOCUMENTS

JP A-10-218148 8/1998
JP A-2004-35110 2/2004

(Continued)

OTHER PUBLICATIONS

Feb. 1, 2011 International Search Report issued in International Patent Application No. PCT/JP2010/068503 (with translation).
Feb. 1, 2011 Written Opinion of the International Searching Authority issued in International Patent Application No. PCT/JP2010/068503 (with translation).

*Primary Examiner* — Jeffrey Allen
(74) *Attorney, Agent, or Firm* — Oliff PLC

(57) ABSTRACT

A synthetic resin round bottle having a shape of the peripheral groove ribs that can increase the plane rigidity of the peripheral sidewall, without lowering the buckling strength in the vertical directions and the moldability of the bottle, including a round bottle having a neck, a tapered cylindrical shoulder, a cylindrical body, a bottom, a pair of peripheral groove ribs disposed at certain height positions of the body and formed in groove shapes, with one groove over the other groove in proximity to each other, where bases of these peripheral groove ribs are inclined relative to the direction of central axis of the bottle in a vertical sectional view, and the incline of a rib base for the upper peripheral groove rib has a direction opposite that of the incline of the rib base for the lower peripheral groove rib.

8 Claims, 10 Drawing Sheets

(56) References Cited

U.S. PATENT DOCUMENTS

| | | | | |
|---|---|---|---|---|
| 2006/0076310 | A1 | 4/2006 | Mooney et al. | |
| 2006/0289379 | A1 | 12/2006 | Ozawa et al. | |
| 2008/0197105 | A1* | 8/2008 | Boukobza | 215/381 |

FOREIGN PATENT DOCUMENTS

| | | |
|---|---|---|
| JP | A-2004-262500 | 9/2004 |
| JP | A-2005-96850 | 4/2005 |
| JP | A-2009-9652 | 1/2009 |

* cited by examiner

[Fig.10]
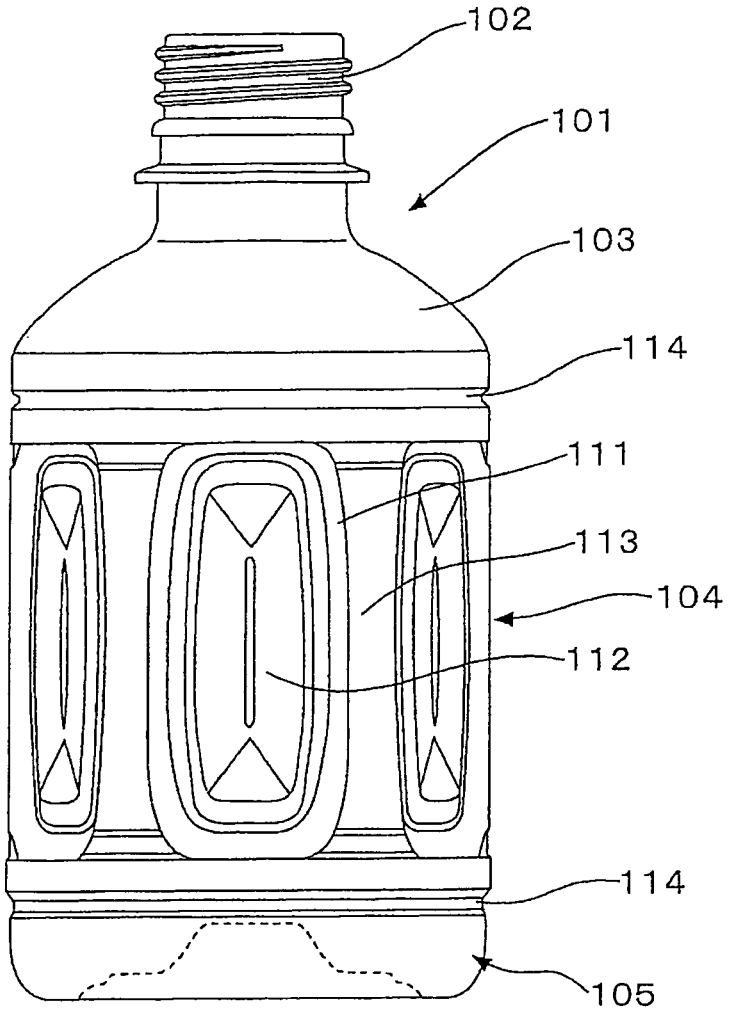
CONVENTIONAL ART

SYNTHETIC RESIN ROUND BOTTLE

TECHNICAL FIELD

This invention relates to a round bottle made of a synthetic resin.

BACKGROUND ART

Biaxially stretched, blow molded bottles made of a polyethylene terephthalate resin (hereinafter referred to as a PET resin) are in wide use for beverages and the like. Patent document 1 discloses a round bottle having a cylindrical body. FIG. 10 shows a bottle described in an embodiment of this patent document 1. The bottle 101 is a biaxially stretched, blow molded round bottle made of a PET resin, i.e., a so-called PET bottle. The bottle 101 comprises a neck 102, a shoulder 103, a body 104, and a bottom 105. Six vacuum-absorbing panels 112 are disposed in the peripheral wall of the body 104 and are surrounded by step portions 111, respectively. Peripheral groove ribs 114 are disposed at upper and lower ends of the body 104.

The vacuum-absorbing panels 112 are substantially flat plates, which are deformable into a dented state toward the inside of the bottle 101 when there is a reduced pressure inside the bottle. In appearance, the bottle 101 gives no abnormal deformation, and performs a function of absorbing the reduced pressure in an inconspicuous manner (hereinafter referred to as the vacuum-absorbing function). The rigidity of the bottle is mainly borne by pillars 113 disposed between two adjacent vacuum-absorbing panels and by the peripheral groove ribs 114.

PRIOR ART DOCUMENT

Patent Document

Japanese patent application No. 2009-96521.

SUMMARY OF THE INVENTION

Technical Problems to be Solved by the Invention

The bottles of this type are used in large numbers in the field of foods. In the meantime, light-weight bottles having a thin wall have been and are in demand from points of view of material saving and cost reduction in packaging, but the wall thinning has its own limit due to bottle rigidity, buckling strength, and bottle moldability. If the bottle wall is too thin, problems arise in production lines, such as filling of contents, packing of bottles in cases, or in the process of conveying or transporting cases packed with many bottles. For example, when bottles bump against the gird rail of the conveyor system or bump against one another inside the case, peripheral sidewall of the body may bend and buckle because of a load in the lateral direction, and the buckles fail to recover to the original shape. Buckling deformation also tends to occur because of the load in the central axial direction of the bottles, i.e., in the vertical directions.

In FIG. 10, peripheral groove ribs 114 are disposed at upper and lower ends of the body 104 of the bottle. These ribs are an effective means of securing plane rigidity of the peripheral sidewall of the bottle, and have been in use conventionally. However, problems arise if the peripheral groove ribs are deepened to increase the plane rigidity of the peripheral sidewall. That is, the buckling strength would decrease in the vertical directions, and furthermore, the blow moldability would decrease. The deeper the peripheral groove ribs are, the larger surface area would result. If the bottle has a certain constant weight, the deeper groove ribs make the peripheral sidewall thinner.

The peripheral sidewall of the body may have high plane rigidity if irregularity of the peripheral sidewall is increased by a plurality of peripheral groove ribs disposed in positions close to one another. On the other hand, if a load acts vertically on the bottle, the deformation of two vertically neighboring peripheral groove ribs may interfere with each other, thus failing to make deformation constant. A so-called "twist" problem would take place, followed by local buckling deformation, which decreases the buckling strength rather than increasing it.

A technical problem of this invention is to create a synthetic resin round bottle having shapes of the peripheral groove ribs that can increase the plane rigidity of the peripheral sidewall, without lowering the buckling strength in the vertical directions and the moldability of the bottle.

Means of Solving the Problem

A main constituent feature of this invention, from among the means of solving the above-described technical problem, is a round bottle comprising a neck, a tapered cylindrical shoulder, a cylindrical body, and a bottom, characterized by further comprising a pair of peripheral groove ribs disposed at certain height positions of the body and formed in groove shapes, with one groove over the other groove in proximity to each other, wherein rib bases of these peripheral groove ribs are inclined relative to the direction of central axis of the bottle in a vertical sectional view, and wherein the incline of a rib base for the upper peripheral groove rib has a direction opposite that of the incline of the rib base for the lower peripheral groove rib.

The above-described feature leaves a ridge portion (hereinafter referred to as the peripheral ridge) formed between this pair of peripheral groove ribs. And because the bases of these peripheral groove ribs are inclined relative to the direction of central axis of the bottle in a vertical sectional view, and also because the incline of the base for the upper peripheral groove rib has a direction opposite that of the incline of the base for the lower peripheral groove rib, the deformation of the peripheral sidewall caused by a load acting vertically on the bottle can be made constant along the circumference in the vicinity of the pair of the peripheral groove ribs and the peripheral ridge disposed in between. The so-called "twist" and local buckling deformation can be prevented from occurring, and thus, the buckling strength can be effectively prevented from lowering.

Each peripheral groove rib comprises a pair of slopes and a recessed wall. In the vertical section, the slopes correspond to the rib sides, and the recessed wall corresponds to the rib base. That the base is inclined relative to the direction of the central axis of the bottle means that the recessed wall is inclined from the central axis of the bottle.

For example, a case is considered where the upper peripheral groove rib has a inclined angle in a downward and outward direction and where the lower peripheral groove rib has the same inclined angle in an upward and outward direction. If force acts on the bottle in the vertical directions, at first the groove width of the peripheral groove ribs becomes narrower, and then, by way of the recessed walls of the upper and lower peripheral groove ribs, the force acts on the peripheral ridge in a direction in which the ridge expands outward along the entire circumference. Therefore, the circular cross-sectional shape of the peripheral sidewall near the peripheral groove ribs can be prevented from deforming. The "twist" and local buckling deformation can also be prevented. A pair of the upper and lower peripheral groove ribs have been formed to increase the plane rigidity, but a decrease in the buckling strength against the vertical load, as caused ordinarily by these ribs, can be effectively prevented from occurring.

According to the above feature, the depth of the grooves can be set to a relatively small extent. The recessed walls having an incline increase moldability and mold releasability in the blow molding operation, and improve productivity. On the whole, the extent of irregularity is minimized, and excessive wall thinning can be controlled.

If the direction of inclination of a base is opposite the above-described case, namely if the upper peripheral groove rib has the inclined angle in an upward and outward direction, with the lower peripheral groove rib being in a downward and outward direction, then the force act on the peripheral groove ribs in a direction in which the peripheral ridge draws back towards the inside of the bottle along the entire circumference.

In the case of a conventional type of peripheral groove ribs, where the direction of the rib base or the recessed wall is in parallel to the central axis, the force of the load in the vertical directions does not act in a specific direction, and deformation of vertically neighboring peripheral groove ribs interferes to each other. Slight deviation in the sidewall thickness or a minimal change in the direction in which the load acts on the peripheral sidewall may cause the peripheral ridge to be either squeezed by the pushing force or pulled by the pull force, thus making deformation unstable. The peripheral ridge turns out to be the portions deformed into an outward expanded state and the portions deformed into an inward receding state. As a result, the plane cross-sectional view of the peripheral ridge changes from a circular shape to an elliptic shape, and the buckling strength decreases because buckling deformation takes place locally.

The height position of a pair of peripheral groove ribs, the number of ribs, dimensions of individual groove ribs, such as the depth and the width, or the distance coming between the upper and lower peripheral groove ribs can be set arbitrarily, taking into consideration the plane rigidity of the peripheral sidewall, necessary buckling strength, the design of external appearance, and moldability.

Another feature of this invention is that, in the above-described main feature, the shapes of the upper and lower peripheral groove ribs are vertically symmetrical to each other in the vertical sectional view.

According to the above feature, action of the force can be equalized along the entire circumference when the force, as caused by a load in a vertical direction, acts on the peripheral ridge in a certain constant direction. The above feature is also effective in preventing the peripheral sidewall near the pair of peripheral groove ribs from deforming from the circular shape in the plane cross-sectional view.

Still another feature of this invention is that, in the main feature described above, the rib base of the upper peripheral groove rib has a inclined angle in a downward and outward direction, while that of the lower peripheral groove rib has the same inclined angle in an upward and outward direction.

According to the above feature, the peripheral ridge deforms into an outward expanded state due to the load acting on the bottle in the vertical directions. This outward expanding deformation of the peripheral ridge described above can be controlled by a shrink label attached around the body. The buckling strength can also be enhanced.

Still another feature of this invention is that, in the main feature described above, a pair of the peripheral groove ribs is disposed in an upper cylindrical portion of the body between the shoulder and multiple vacuum-absorbing panels, which are formed in a dented state and are disposed in the peripheral sidewall of the body so as to stand in parallel in the circumferential direction.

In the case of the round bottles having multiple vacuum-absorbing panels formed in a dented state and disposed in the peripheral sidewall of the body so as to stand in parallel in the circumferential direction around the body, pillars are formed between neighboring vacuum-absorbing panels to bear the rigidity and strength of the body. On the other hand, the vacuum-absorbing panels in the dented state tend to decrease the plane rigidity of the peripheral sidewall. Especially in the case of small-size bottles, the area used for these vacuum-absorbing panels has to be limited. Thus, weight saving by means of wall thinning is a very difficult task, considering balance between the vacuum-absorbing function and the plane rigidity or buckling strength of the peripheral sidewall.

Consequently, the peripheral groove ribs are formed in both of the upper and lower ends of the body, i.e., on and under the vacuum-absorbing panels, to make up for a decrease in plane rigidity caused by the vacuum-absorbing panels formed in the body wall. According to the above feature, a pair of the peripheral groove ribs is disposed in the upper cylindrical portion under the tapered cylindrical shoulder, and is located between the shoulder and the vacuum-absorbing panels where the buckling strength becomes relatively low. This can make up for the decreased plane rigidity without giving damage to the buckling strength to bear with the force acting in the vertical directions. Further weight saving can be achieved even for the bottles having vacuum-absorbing panels.

Effects of the Invention

This invention having the above-described features has the following effects:

According to the main feature, the bases of the peripheral groove ribs are inclined relative to the direction of central axis of the bottle in a vertical sectional view, and the incline of the rib base for the upper peripheral groove rib has a direction opposite that of the incline of the rib base for the lower peripheral groove rib. Owing to this design, the force acting on the peripheral ridge under a load of the bottle working in the vertical directions can be made constant along the entire circumference of the peripheral ridge, and the circular cross-sectional shape of the peripheral sidewall near the pair of the peripheral groove ribs can be prevented from deforming into an oval shape. The "twist" and local buckling deformation can be prevented from occurring in the area concerned. A decrease in buckling strength tends to be incurred by arranging the peripheral groove ribs as the pair of upper and lower ribs, but the main feature described above can prevent the buckling strength effectively from lowering, while increasing plane rigidity.

BRIEF DESCRIPTION OF THE INVENTION

FIG. 10 is a front view of a round bottle in a conventional example.

PREFERRED EMBODIMENTS OF THE INVENTION

Figure 1:
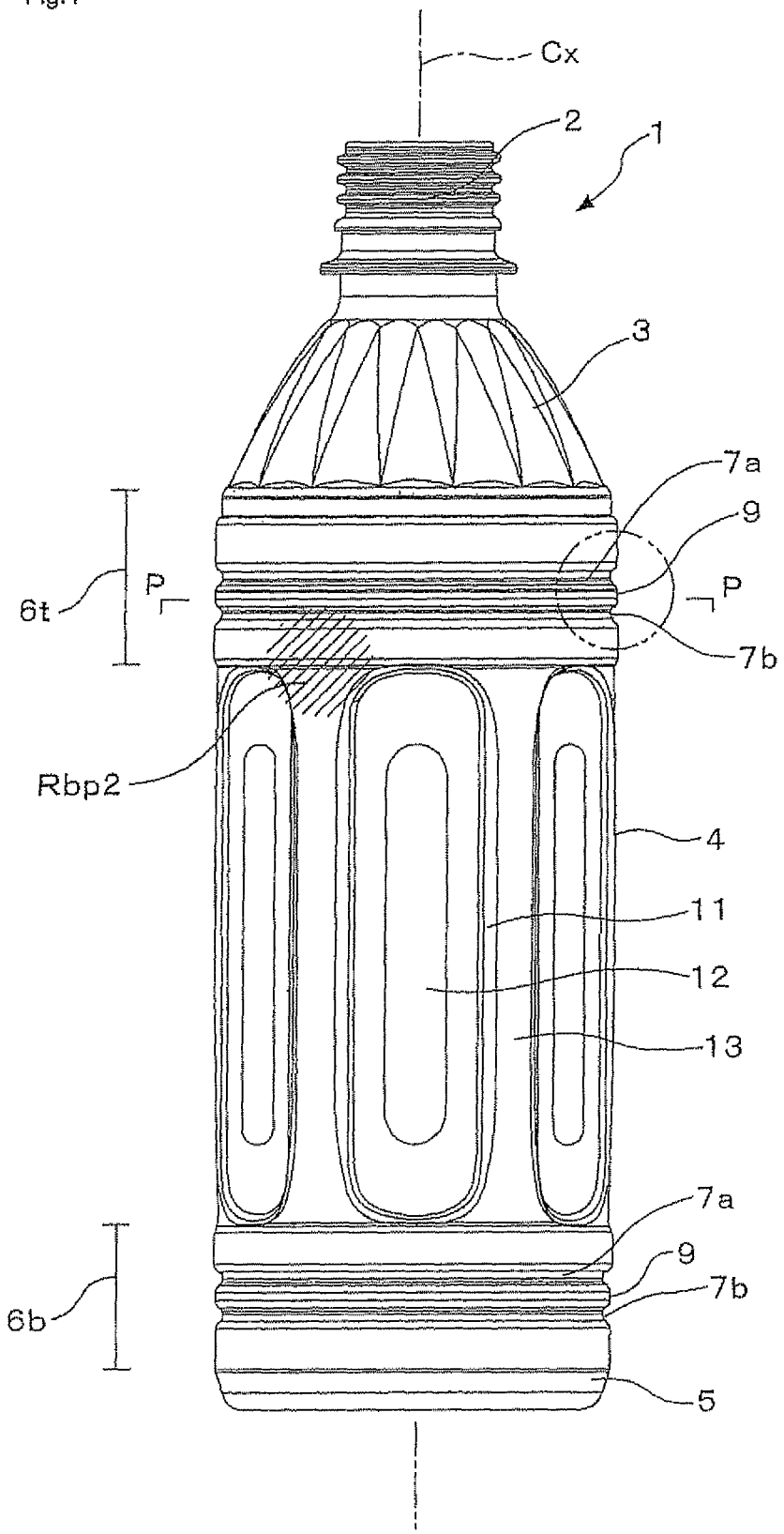
FIG. 1 is a front view of an entire round bottle in one embodiment of this invention.
Figure 2:
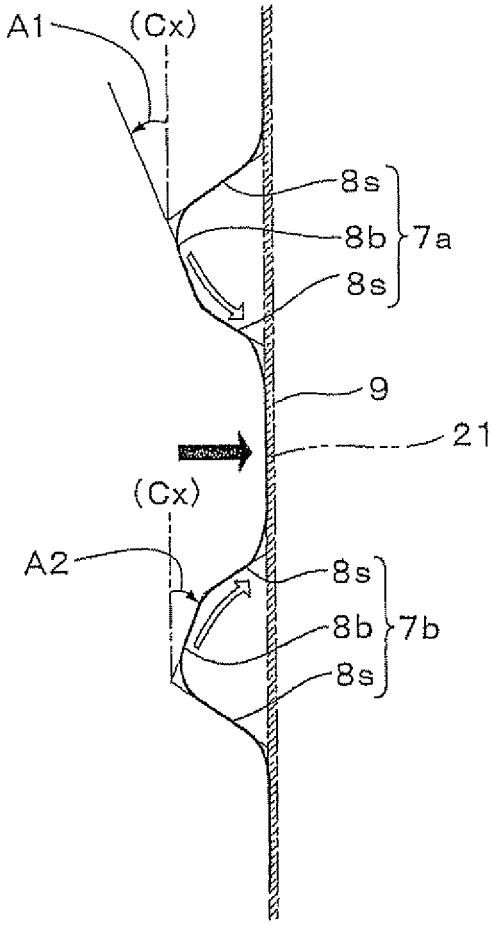
FIG. 2 is a vertical section of a peripheral sidewall in an area surrounded by a two-dot chain line in FIG. 1.

This invention is further described with respect to preferred embodiments of the synthetic resin round bottle of this invention, now referring to the drawings. FIGS. 1 and 2 show the round bottle in a preferred embodiment of this invention. FIG. 1 is a front view; and FIG. 2 is an enlarged vertical section of the peripheral sidewall in an area circled by a two-dot chain line in FIG. 1, showing a pair of upper and lower peripheral groove ribs 7*a* and 7*b* in the vertical section. The bottle 1 is a biaxially stretched, blow molded product (a PET bottle) made of a PET resin. The bottle 1 comprises a neck 2, a tapered cylindrical shoulder 3, a cylindrical body 4, and a bottom 5, and is a round bottle having a total height of 206 mm, a lateral width of 68 mm, and a capacity of 500 ml.

Six vacuum-absorbing panels 12 in an oblong shape are disposed in the peripheral sidewall of the cylindrical body 4, in parallel in the circumferential direction, and each panel 12 is dented and surrounded by a step portion 11. Six vertical pillars 13 are disposed respectively between two neighboring vacuum-absorbing panels 12 to bear the rigidity and buckling strength of the bottle 1.

An upper cylindrical portion 6*t* is disposed in an upper end portion of the body 4, i.e., between the shoulder 3 and the vacuum-absorbing panels 12. This cylindrical shape is left with no vacuum-absorbing panel 12 being formed. Similarly, a lower cylindrical portion 6*b* is disposed in a lower end portion of the body 4, i.e., between the bottom 5 and the vacuum-absorbing panels 12.

A pair of the peripheral groove ribs 7*a* and 7*b* is disposed in each of the upper cylindrical portion 6*t* and likewise in the lower cylindrical portion 6*b*, and each pair of ribs is formed in groove shapes, with one groove that is a upper peripheral groove rib (7*a*) over the other groove that is a lower peripheral groove rib (7*b*) in proximity to each other. A peripheral ridge 9 is left projecting between the upper rib 7*a* and the lower rib 7*b*. The vertical sectional shape of these peripheral groove ribs 7*a*, 7*b* comprises a rib base 8*b* and a pair of rib sides 8*s*. The rib bases 8*b* incline from the direction of central axial Cx of the bottle 1, and the incline of the rib base 8*b* for the upper peripheral groove rib 7*a* has a direction opposite that of the incline of the rib base 8*b* for the lower peripheral groove rib 7*b* (See FIG. 2). Each of the peripheral groove ribs 7*a*, 7*b* comprises a pair of upper and lower slopes and a recessed wall. In the vertical section, the slopes correspond to the rib sides 8*s*, and the recessed wall corresponds to the rib base 8*b*. That the rib base 8*b* is inclined relative to the direction of the central axis Cx of the bottle means that the recessed wall is inclined from the central axis Cx of the bottle 1. The shapes of the peripheral groove ribs 7*a*, 7*b* formed in the lower cylindrical portion 6*b* are similar to those shown in FIG. 2.

The shapes of the upper peripheral groove rib 7*a* and the lower peripheral groove rib 7*b* are vertically symmetrical to each other in the vertical sectional views. Regarding the direction of the rib base 8*b*, the upper peripheral groove rib 7*a* has a inclined angle in a downward and outward direction, and the lower peripheral groove rib 7*b* has the same inclined angle in an upward and outward direction. In more details, these ribs 7*a*, 7*b* have a maximum groove depth of 1.5 mm, a groove width of 3 mm at the upper end (corresponding to the right end in FIG. 2), a incline A1 of −25 degrees for the upper peripheral groove rib 7*a* and a incline A2 of +25 degrees for the lower peripheral groove rib 7*b* (assuming that the clockwise direction is a plus direction in FIG. 2), and a crest width of 3 mm for the peripheral ridge 9, which corresponds to a distance between both ribs 7*a* and 7*b*.

If a vertical load acts on the bottle 1 of this embodiment, the force would act in the directions shown by outline arrows in FIG. 2 in areas ranging from the sloping rib bases 8*b* to rib sides 8*s* of the peripheral groove ribs 7*a*, 7*b*. As a result, the force acts on the peripheral ridge 9 in the direction outward from the bottle 1, as shown by a solid arrow.

Figure 3:
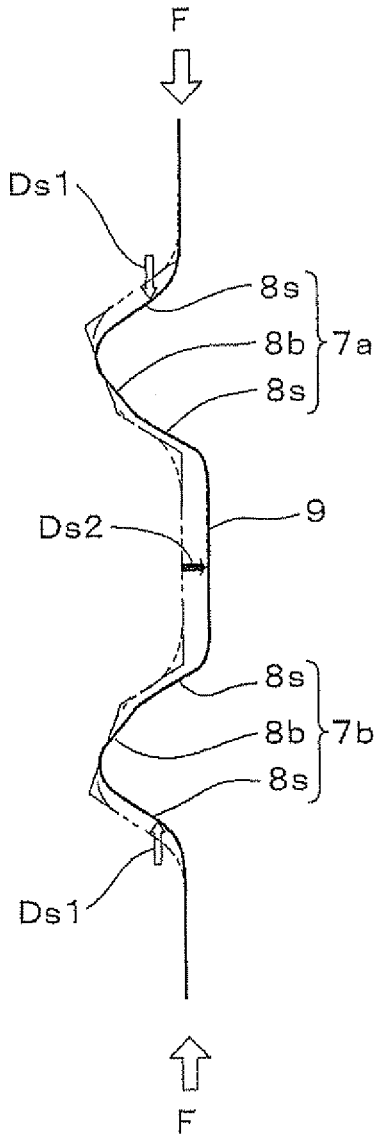
FIG. 3 is a schematic diagram explaining a positional change in a pair of the upper and lower peripheral groove ribs of FIG. 2.

FIG. 3 is a schematic diagram explaining the positional change in the pair of the upper and lower peripheral groove ribs 7*a*, 7*b*. In FIG. 3, a two-dot chain line indicates the shape of ribs before deformation (i.e., the shape shown in FIG. 2), and a solid line indicates the shape of ribs after deformation. As shown in FIG. 3, if the force F acts on the bottle 1 in the vertical directions, at first the peripheral groove ribs 7*a*, 7*b* deform, and the groove width becomes narrow, as shown by outline arrows Ds1. Then, the upper and lower sloping rib bases 8*b* act on the peripheral ridge 9 to push it from upward and downward. Thus, the peripheral ridge 9 deforms into an expanded state in the direction shown by a solid arrow Ds2, i.e., in the direction outward from the bottle 1. As far as the shape of the peripheral sidewall near the peripheral groove ribs 7*a*, 7*b* is concerned, the force acting on the peripheral ridge 9, i.e., the force shown by the solid arrow in FIG. 2, tends to act on the peripheral sidewall almost uniformly along the circumference. The circular peripheral ridge 9 is prevented from deforming into an oval shape in the plane cross-sectional view. Partial deformation of the peripheral ridge 9 into the expanded state can be effectively controlled.

When the bases 8*b* of the upper and lower peripheral groove ribs 7*a*, 7*b* are inclined such as shown in FIG. 2, the change in the position of the peripheral sidewall caused by a load in the vertical directions can be maintained constant along the entire circumference in the area of peripheral sidewall near the pair of upper and lower peripheral groove ribs 7*a*, 7*b* including the peripheral ridge 9 in between, as shown in FIG. 3. Local buckling deformation caused by a load in the vertical directions can be effectively controlled. The so-called "twist," a failure to make deformation constant along the circumference, can be prevented from occurring. In addition, the pair of upper and lower peripheral groove ribs 7*a*, 7*b* can increase plane rigidity of the bottle effectively, without damaging the buckling strength bearing a load in the vertical directions.

In many cases, the PET bottles of this type utilize shrink labels, which are attached around the body ranging from under the lower end of the shoulder 3 to the bottom 5. In FIG. 2, a two-dot chain line indicates a shrink label 21 that covers the bottle 1 of this embodiment. Once the bottle 1 is covered with the shrink label 21, the peripheral ridge 9 is prevented by the shrink label from deforming into the expanded state such as shown in FIG. 3, and the buckling deformation can be effectively controlled.

Figure 4:
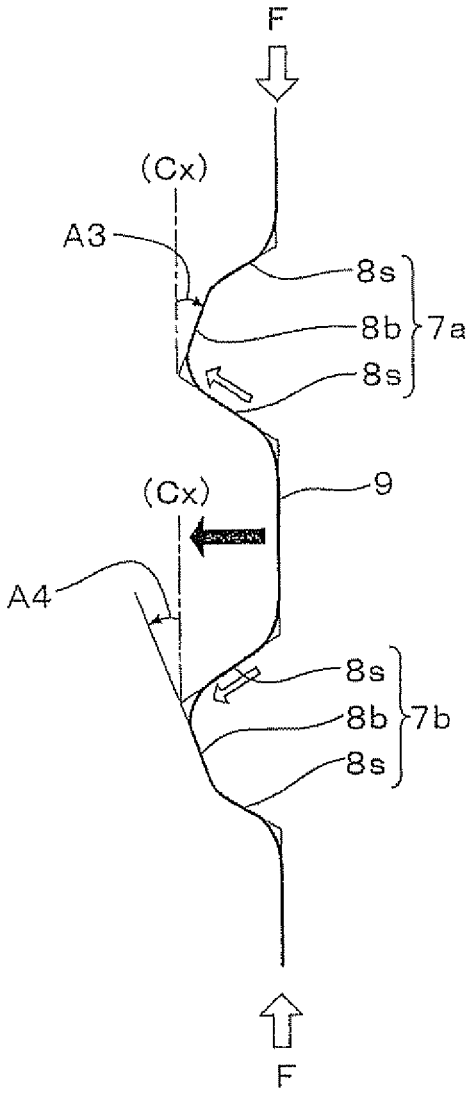
FIG. 4 is a vertical section of the peripheral sidewall similar to FIG. 2 but in another embodiment of this invention.

FIG. 4 shows the vertical sectional shapes of a pair of the peripheral groove ribs 7*a*, 7*b* in another embodiment. As compared with the vertical section of the first embodiment shown in FIG. 2, the rib bases 8*b* of the upper and lower peripheral groove ribs 7*a*, 7*b* are inclined in reverse directions. Namely, the upper peripheral groove rib 7*a* has an inclined angle A3 of +25 degrees, while the lower peripheral groove rib 7*b* has an inclined angle A4 of −25 degrees.

In this case, a load acts in the vertical directions on the bottle 1 having the pair of upper and lower peripheral groove ribs 7*a*, 7*b*, which are disposed as shown in FIG. 4. The force, pull force in this case, acts on the nearby rib sides 8*s* of the peripheral groove ribs 7*a*, 7*b* in directions shown by outline arrows in FIG. 4. As a result, the force headed for the inside of the bottle 1 acts on the peripheral ridge 9, as shown by a solid arrow.

Figure 5:
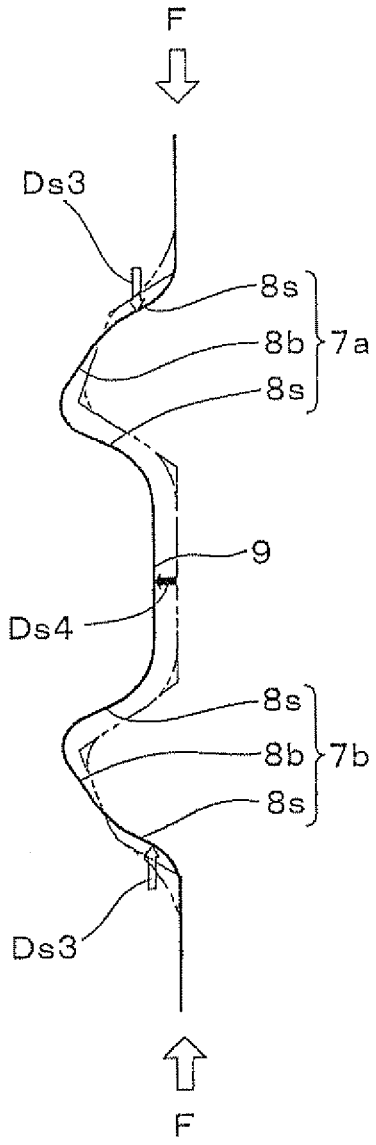
FIG. 5 is a schematic diagram explaining a positional change in a pair of upper and lower peripheral groove ribs of FIG. 4.

FIG. 5 is a schematic diagram explaining a mode of deformation that takes place at that time. In FIG. 5, the two-dot chain line indicates the shape of the peripheral groove ribs before deformation (i.e., the shape shown in FIG. 4); and the solid line indicates the shape after deformation. As seen in this FIG. 5, if the force F acts on the bottle 1 in the vertical directions, at first the peripheral groove ribs 7*a*, 7*b* deform so as to narrow the grooves, as shown by outline arrows Ds3. In addition, due to the effect of the sloping upper and lower rib bases 8*b*, the pull force acts on the peripheral ridge 9, to deform the ridge into a state receding toward the inside of the bottle 1, i.e., in the direction shown by the solid arrow Ds4, which is opposite the direction shown in FIG. 3. As far as the shape of the peripheral sidewall near the peripheral groove ribs 7*a*, 7*b* is concerned, the force acting on the peripheral ridge 9, i.e., the force shown by the solid arrow in FIG. 4, tends to act on the peripheral sidewall almost uniformly along the circumference. The circular peripheral ridge 9 is prevented from deforming into an oval shape in the plane cross-sectional view. Partial deformation of the peripheral ridge 9 into an expanded state can be effectively controlled.

In this embodiment, too, the change in the position of the peripheral sidewall can be maintained constant along the entire circumference in the area of peripheral sidewall near the pair of upper and lower peripheral groove ribs 7*a*, 7*b* including the peripheral ridge 9 in between, as shown in FIG. 5. The "twist" can be prevented from occurring, and the pair of upper and lower peripheral groove ribs 7*a*, 7*b* can increase plane rigidity of the bottle effectively, without damaging the buckling strength bearing a load in the vertical directions.

Figure 6:
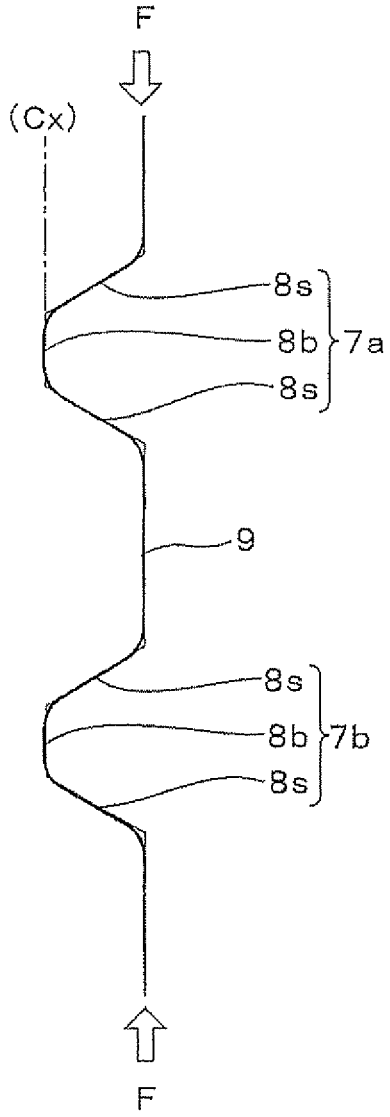
FIG. 6 is a vertical section of a pair of upper and lower peripheral groove ribs in a comparative example.
Figure 7:
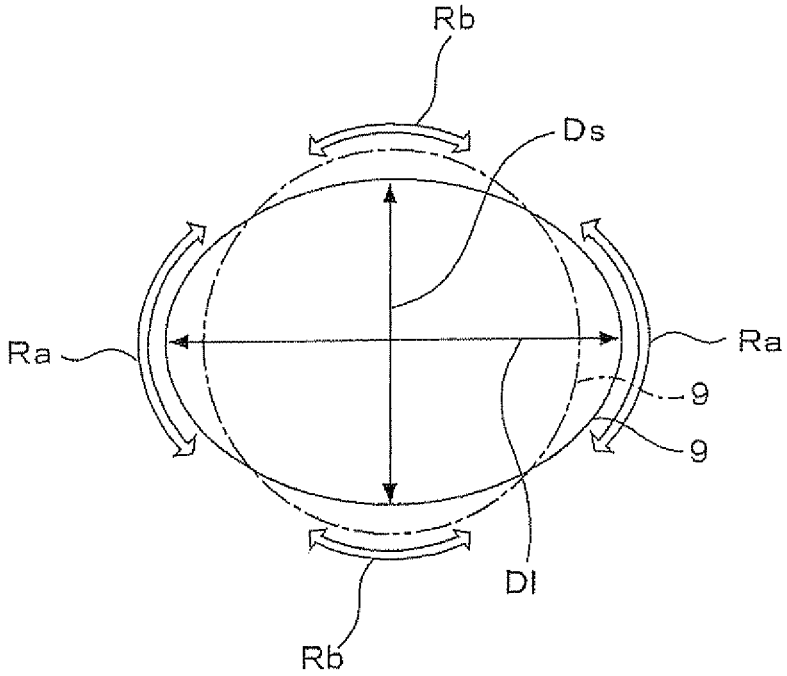
FIG. 7 is a schematic diagram explaining a change in the shape of the peripheral groove ribs of FIG. 6, shown in a plane cross-sectional view taken along line P-P in FIG. 1.

FIG. 6 shows a comparative example for the pair of peripheral groove ribs 7*a*, 7*b* shown in FIGS. 2 and 4. In this case, the rib bases 8*b* are in parallel to the direction of central axis Cx of the bottle. The peripheral groove ribs 7*a*, 7*b* of this example have a groove depth of 1.5 mm, a groove width of 3 mm at the upper end, and the peripheral ridge 9 has a top width of 3 mm, which corresponds to the distance coming between both groove ribs 7*a*, 7*b*. FIG. 7 is a schematic diagram explaining a change in the shape of the peripheral groove ribs 7*a*, 7*b* of FIG. 6, shown in a plane cross-section taken along line P-P in FIG. 1. The circle shown by a one-dot chain line is a cross-sectional shape before deformation, and the elliptical shape shown by a solid line indicates the cross-sectional shape after the deformation has been in progress.

In the case of the peripheral groove ribs 7*a*, 7*b* having the rib bases 8*b* in parallel to the central axis Cx, as is the case of this comparative example, the direction of the force acting on the ribs cannot be maintained constant by the parallel rib bases 8*b*, contrary to the case of the sloping rib bases 8*b*. The direction of force would rather be shifted by slight deviation from the right thickness of the peripheral sidewall or by a small difference in the direction of a load. The pushing force may act on the peripheral ridge 9 at some points along the circumference, while the pull force may act at other points, thus leaving the peripheral ridge 9 both in a state expanding toward the outside of the bottle 1 and in a state receding toward the inside of the bottle 1. As a result, the circular plane cross-sectional shape of the peripheral ridge 9 deforms into an elliptical shape, as shown in FIG. 7. Because local buckling deformation develops, the buckling strength inevitably decreases.

In FIG. 7, Dl and Ds indicate a long diameter and a short diameter, respectively, of the elliptical shape after the peripheral ridge 9 has deformed. Regions Ra in the major axial direction, shown by outline arrows in FIG. 7, are where the peripheral ridge 9 has expanded toward outside of the bottle. Regions Rb in the minor axial direction are where the ridge 9 has receded toward the inside of the bottle.

Figure 8:
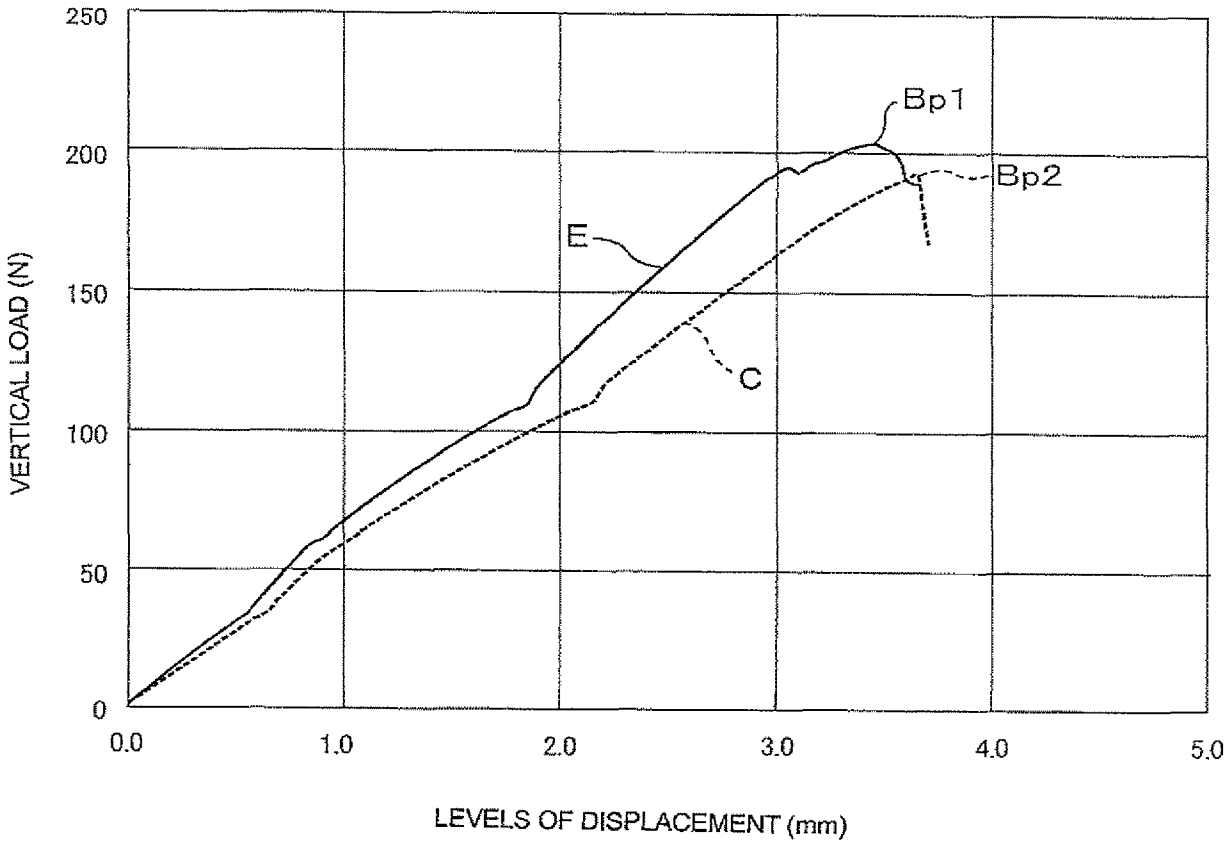
FIG. 8 is a graph showing results of a buckling strength test.
Figure 9:
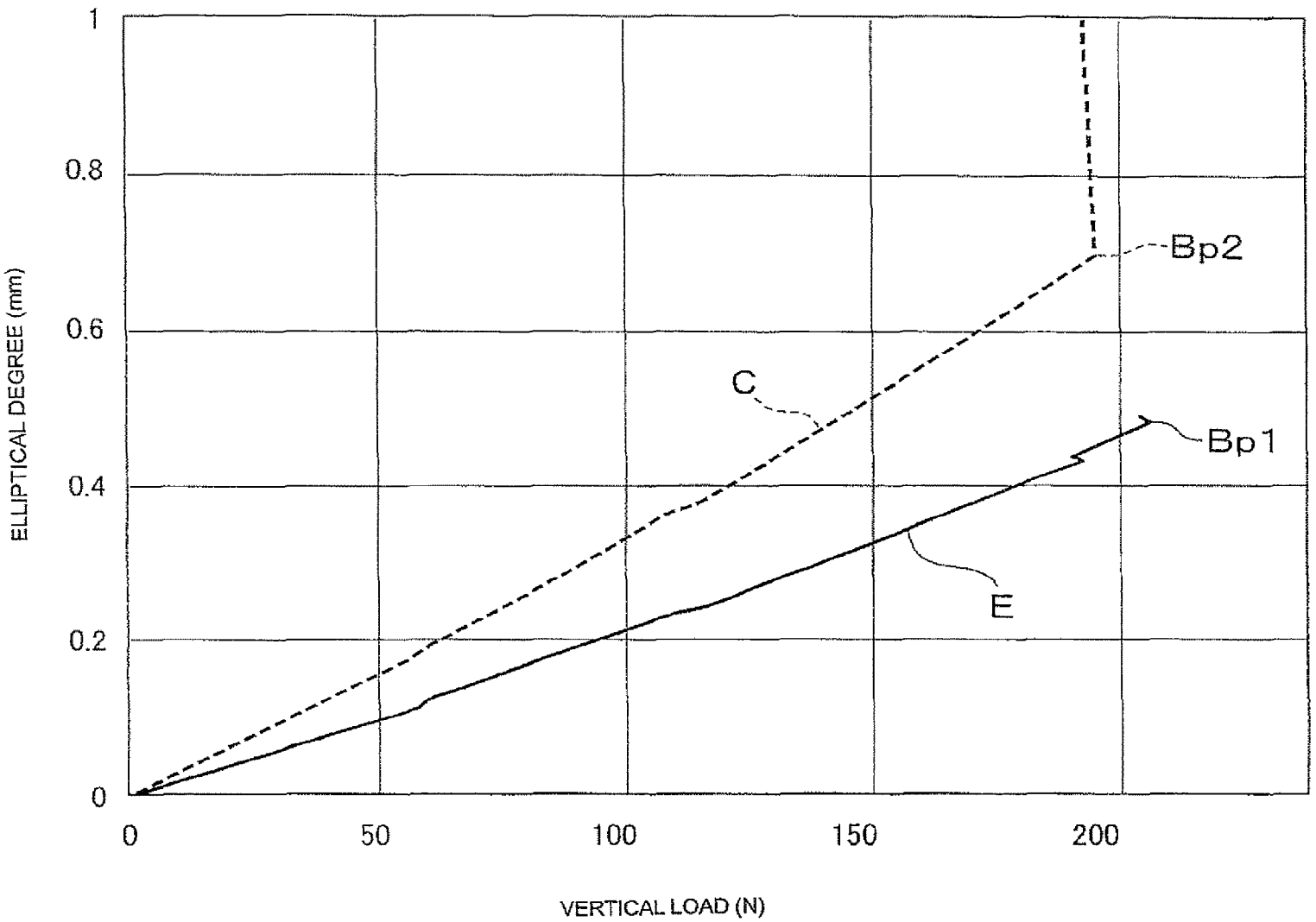
FIG. 9 is another graph showing results of a buckling strength test.

Buckling strength tests were conducted by applying vertical loads to the bottles. The tested bottles were those of FIG. 1, but in one embodiment, the peripheral groove ribs 7*a*, 7*b* had vertical sectional shapes of FIG. 4, while in the comparative example, the ribs 7*a*, 7*b* had a vertical sectional shape of FIG. 6. FIG. 8 is a graph showing results of the buckling strength tests in which changes in vertical load (N) were measured against the levels of displacement (mm) in the total bottle height. Curve E shows a curve of bottle height displacement vs. load measured with the bottles in the embodiment of this invention in which the peripheral groove ribs 7*a*, 7*b* had vertical sectional shapes of FIG. 4. Curve C is a counterpart measured with the bottle of the comparative example. FIG. 9 is a graph of elliptical degrees showing how the plane cross-sectional shape of the peripheral ridge 9 taken along the line P-P in FIG. 1 is changed by the loads where the elliptical degree, in mm, is a difference between a longest diameter and a shortest diameter. The elliptical degree is an indicator of the progress from the circle to an ellipse. It is 0 mm in the case where there is no change from the original circle. The value increases with the progress of elliptical deformation, as shown by a solid line in FIG. 7.

In FIG. 8, Bp1 is the buckling point for the bottle of the embodiment of this invention; Bp2 is the buckling point for the bottle of the comparative example. The bottle of the embodiment had a buckling strength of 205.7 N, and the bottle of the comparative example had a buckling strength of 194.5 N. Thus, the test proved an action-and-effect of the feature regarding the shape of the peripheral groove ribs of this invention.

As recognizable from the test curve C in FIG. 9, the bottle of the comparative example proceeded from the beginning to show larger deformation into an elliptical shape than did the bottle of the embodiment. The deformation was found to grow sharply at or near the buckling point Bp2. Local buckling deformation took place in regions indicated by Rbp2 in FIG. 1, i.e., in the vicinity of upper ends of pillars 13. As described above, the peripheral ridge 9 of the bottle of the comparative example fails to keep deformation constant. The so-called "twist" problem would take place, thus leaving the peripheral ridge 9 both in a state expanding toward the outside of the bottle 1 and in a state receding toward the inside of the bottle 1. As a result, the circular plane cross-sectional shape of the peripheral ridge 9 deforms into an oval shape, as shown in FIG. 7. It was confirmed from the graph of this FIG. 9 that because of this drastic ovalization, there occur local buckling deformation and the resultant decrease in buckling strength in the bottle of the comparative example.

As obvious from a comparison of vertical sectional shapes of the peripheral groove ribs 7*a*, 7*b* between the embodiment of FIGS. 2 and 4 and the comparative example of FIG. 6, the peripheral groove ribs 7*a*, 7*b* of FIGS. 2 and 4 have better thickness conditions in the blow molding, better releasability, and improved productivity because grooves can have a relatively small depth and because the recessed walls are sloping.

This invention has been described with respect to preferred embodiments and their action-and-effects, but it is to be understood that this invention should not be construed as limitative to these embodiments. For instance, the embodiments have been described on a round bottle having vacuum-absorbing panels in the body wall, but the action-and-effects regarding the shape of the peripheral groove ribs of this invention can also be performed fully for a round bottle having no vacuum-absorbing panels in the body wall.

The dimensions of a pair of the peripheral groove ribs, including height position, number of ribs, the groove depth and width of individual peripheral groove ribs, and like, can be arbitrarily determined, giving consideration to plane rigidity of the peripheral sidewall, necessary buckling strength, appearance design, and moldability. In addition, in the above embodiments, the upper and lower peripheral groove ribs 7*a*, 7*b* are described as the vertical sectional shapes which are in vertically symmetrical to each other. However, these ribs 7*a*, 7*b* cannot always be vertically symmetrical within the category that the sloping directions of rib bases 8*b* are opposite each other.

The bottle is not limited to a capacity of about 500 ml. The bottle was described as being made of a PET resin, but this invention is applicable also to other synthetic resin bottles, such as those made of a polypropylene resin and the like.

INDUSTRIAL APPLICABILITY

As described above, the synthetic resin round bottle of this invention comprises a pair of upper and lower peripheral groove ribs disposed in proximity to each other. Because of the shapes of recessed walls of these ribs, the peripheral sidewall is capable of having large plane rigidity without lowering the buckling strength in the vertical directions and the moldability of the bottle. Thus, wide application of use can be expected from points of view of resources saving and cost reduction to be attained by wall thinning efforts.

DESCRIPTION OF REFERENCE SIGNS

1, 101. Bottle
2, 102. Neck
3. 103. Shoulder
4. 104. Body
5. 105. Bottom
6*t*. Upper cylindrical portion
6*b*. Lower cylindrical portion
7*a*. Upper peripheral groove rib
7*b*. Lower peripheral groove rib
8*b*. Rib base
8*s*. Rib side
9. Peripheral ridge
11, 111. Step portion
12, 112. Vacuum-absorbing panel
13, 113. Pillar
114. Peripheral groove rib
21. Shrink film
Cx. Central axis
A1, A2, A3, A4. Inclined angle

The invention claimed is:

1. A synthetic resin round bottle comprising a neck, a tapered cylindrical shoulder, a cylindrical body, a bottom, a pair of peripheral groove ribs disposed at certain height positions of the body and formed in groove shapes, each peripheral groove rib has a pair of rib sides and a rib base, each of the rib sides of a respective peripheral groove rib is connected to a surface of the bottle and a respective rib base, each respective rib base is between the pair of rib sides of the respective peripheral groove rib, a shape of each peripheral groove rib is asymmetrical vertically in and of itself, with one groove that is an upper peripheral groove rib over the other groove that is a lower peripheral groove rib in proximity to each other, wherein:

rib bases of the peripheral groove ribs are inclined relative to the direction of central axis of the bottle in a vertical sectional view, and the incline of a rib base for the upper peripheral groove rib has a direction opposite that of the incline of the rib base for the lower peripheral groove rib.

2. The synthetic resin round bottle according to claim 1, wherein the shape of the upper peripheral groove rib and the shape of the lower peripheral groove rib are vertically symmetrical to each other in the vertical sectional view.

3. The synthetic resin round bottle according to claim 1, wherein the rib base of the upper peripheral groove rib has a inclined angle in a downward and outward direction, while that of the lower peripheral groove rib has the same inclined angle in an upward and outward direction.

4. The synthetic resin round bottle according to claim 1, wherein a pair of the peripheral groove ribs is disposed in an upper cylindrical portion of the body between the shoulder and multiple vacuum-absorbing panels, which are formed in a dented state and are disposed in a peripheral sidewall of the body so as to stand in parallel in the circumferential direction.

5. The synthetic resin round bottle according to claim 2, wherein the rib base of the upper peripheral groove rib has a inclined angle in a downward and outward direction, while that of the lower peripheral groove rib has the same inclined angle in an upward and outward direction.

6. The synthetic resin round bottle according to claim 2, wherein a pair of the peripheral groove ribs is disposed in an upper cylindrical portion of the body between the shoulder and multiple vacuum-absorbing panels, which are formed in a dented state and are disposed in a peripheral sidewall of the body so as to stand in parallel in the circumferential direction.

7. The synthetic resin round bottle according to claim 3, wherein a pair of the peripheral groove ribs is disposed in an upper cylindrical portion of the body between the shoulder and multiple vacuum-absorbing panels, which are formed in a dented state and are disposed in a peripheral sidewall of the body so as to stand in parallel in the circumferential direction.

8. The synthetic resin round bottle according to claim 5, wherein a pair of the peripheral groove ribs is disposed in an upper cylindrical portion of the body between the shoulder and multiple vacuum-absorbing panels, which are formed in a dented state and are disposed in a peripheral sidewall of the body so as to stand in parallel in the circumferential direction.

* * * * *